US008617377B2

(12) United States Patent
Hayashida

(10) Patent No.: US 8,617,377 B2
(45) **Date of Patent: *Dec. 31, 2013**

(54) METHOD FOR A METAL ELECTROWINNING

(75) Inventor: Toshikazu Hayashida, Kanagawa (JP)

(73) Assignee: Permelec Electrode Ltd., Kanagawa (JP)

( * ) Notice: Subject to any disclaimer, the term of this patent is extended or adjusted under 35 U.S.C. 154(b) by 93 days.

This patent is subject to a terminal disclaimer.

(21) Appl. No.: 13/273,739

(22) Filed: Oct. 14, 2011

(65) Prior Publication Data

US 2012/0111735 A1 May 10, 2012

(30) Foreign Application Priority Data

Nov. 4, 2010 (JP) ..... 2010-247792

(51) Int. Cl.
*C25C 1/00* (2006.01)
*C25C 1/08* (2006.01)

(52) U.S. Cl.
USPC ..... 205/560; 205/570; 205/576; 205/582; 205/591; 205/600; 205/606; 205/612

(58) Field of Classification Search
USPC ..... 205/560, 570, 576, 582, 591, 600, 606, 205/612
See application file for complete search history.

(56) References Cited

U.S. PATENT DOCUMENTS

| | | | | |
|---|---|---|---|---|
| 3,645,862 | A | 2/1972 | Cotton et al. | |
| 4,230,544 | A | 10/1980 | McRae | |
| 4,242,185 | A | 12/1980 | McRae | |
| 4,585,540 | A | 4/1986 | Beer et al. | |
| 4,797,182 | A * | 1/1989 | Beer et al. | 205/80 |
| 8,366,889 | B2 * | 2/2013 | Hayashida | 204/290.14 |
| 2004/0188247 | A1 * | 9/2004 | Hardee | 204/290.14 |

FOREIGN PATENT DOCUMENTS

| | | |
|---|---|---|
| EP | 0437178 | 12/1990 |
| JP | 58-136790 | 8/1983 |
| JP | 62-240780 | 10/1987 |
| JP | 62-243790 | 10/1987 |

OTHER PUBLICATIONS

Yi et al.: "Effect of Ir02 loading on Ru02-Ir02-Ti02 anodes: A study of microstructure and working life for the chlorine evolution reaction" Ceramics International, Elsevier, Amsterdam, NL. vol. 33, No. 6, Jun. 25, 2007, pp. 1087-1091, XP022127750, ISSN: 0272-8842, DOI: 10.1016/J. Ceramint.2006.03.025.

* cited by examiner

*Primary Examiner* — Arun S Phasge
(74) *Attorney, Agent, or Firm* — Hamre, Schumann, Mueller & Larson, P.C.

(57) ABSTRACT

An electrowinning method of metals through electrolysis of a metal chloride solution uses an anode comprising a substrate comprising titanium or titanium alloy, and a coating layer comprising a plurality of a unit layer, provided on the surface of the substrate. The unit layer comprises the first coating layer comprising a mixture of iridium oxide, ruthenium oxide and titanium oxide and the second coating layer comprising a mixture of platinum and iridium oxide. The first coating layer contacts with the surface of said substrate and an outer coating layer of the unit layer formed on the outermost layer of said coating layer is the second coating layer. The coating layer is formed by thermal decomposition baking, which followed by post-baking at a higher baking temperature.

6 Claims, 1 Drawing Sheet

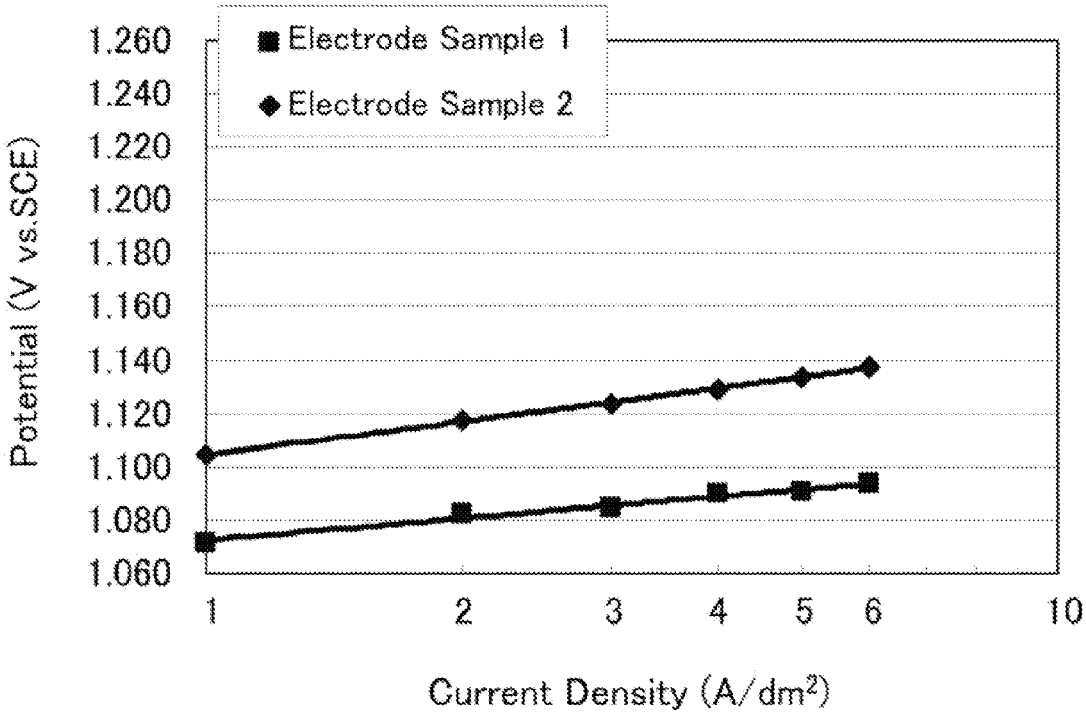
Electrode Sample 1
Electrode Sample 2
1.260
1.240
1.220
1.200
1.180
1.160
1.140
1.120
1.100
1.080
1.060
Potential (V vs.SCE)
1
2
3
4
5
6
10
Current Density (A/dm2)

METHOD FOR A METAL ELECTROWINNING

CROSS-REFERENCE TO RELATED APPLICATIONS

This application is based upon and claims the benefit of priority of Japanese Patent Application 2010-247792, filed on Nov. 4, 2010; the entire contents of which are incorporated herein by reference.

BACKGROUND OF THE INVENTION

1. Field of the Invention

The present invention relates to an electrowinning method of metals through electrolysis of a metal chloride solution to precipitate metals on the cathode.

2. Description of the Related Art

The electrolytic metal extraction methods include the electrolytic refining process in which metals are precipitated on the cathode by electrolysis, applying a crude metal for the anode and the electrowinning process in which metals in the electrolyte are precipitated on the cathode, applying an anode for electrolysis.

For such electrolyte, a sulphate bath and a chloride bath have been applied. The chloride bath can achieve a lower production cost including power cost, because the chloride bath has a larger electrical conductivity of liquid than the sulphate bath, which leads to a lower electrolytic voltage. Metals which can be extracted by the chloride bath, for example, are nickel, cobalt, zinc and copper.

In the electrowinning method of metals applying an anode for electrolysis in the chloride bath, chlorine gas evolves at the anode. The chlorine generating mechanism is expressed by the following chemical equation.

$$2Cl^- \rightarrow Cl_2 + 2e^-$$

The present invention discusses reducing power consumption, focusing on the fact that the power consumption can be lowered by the following equation, if an anode with a low chlorine overvoltage is applied.

Effect of Decrease in Power Consumption=Reduced amount of Overvoltage×Current Density×Sum of Electrode Area×Electrolysis Hour As an anode with a low chlorine overvoltage, a specification applying platinum component is promising. Conventionally, the following anodes for electrolysis by a specification applying platinum component have been reported, which comprises:

an anode having the first coating layer of platinum-iridium oxide mixture, on which the second coating layer by a mixture of 2-50 mass % of manganese oxide containing non-stoichiometric compound, expressed as $MnO_x$ (x being 1.5 or more but less than 2.0) and 50-98 mass % of titanium oxide having a rutile structure is provided (Patent Literature 1); an anode having the first coating layer by a mixture of 20-80 mol. % of platinum and 20-80 mol. % of iridium oxide having a rutile structure and the second coating layer by a mixture of 3-15 mol. % of iridium oxide having a rutile structure, 5-25 mol. % of ruthenium oxide and 60-92 mol. % of titanium oxide, these two layers constituting a unit layer (Patent Literature 2); and an anode having the first coating layer by a mixture of 20-80 mol. % of platinum and 20-80 mol. % of iridium oxide having a rutile structure and the second coating layer by a mixture of 3-15 mol. % of iridium oxide having a rutile structure and 5-25 mol. % of ruthenium oxide and 60-92 mol. % of tin oxide, these two layers constituting a unit layer, the anode being provided with a single, or multiple numbers of the unit layer (Patent Literature 3).

However, all of these anodes have been developed for the use of chlor-alkali electrolysis and the effect of decrease in power consumption in metal electrowinning method is not always sufficient. Further improvement is anticipated.

PATENT LITERATURE

[Patent Document 1] Japanese Unexamined Patent Application Publication No. 58-136790

[Patent Document 2] Japanese Unexamined Patent Application Publication No. 62-240780

[Patent Document 3] Japanese Unexamined Patent Application Publication No. 62-243790

SUMMARY OF THE INVENTION

Technical Problem

The present invention, intending to provide a metal electrowinning method which can reduce power consumption significantly, can give a lower chlorine overvoltage, compared with a former anode, in the metal electrowinning method applying a chloride bath.

The metal electrowinning method by the present invention can be utilized in metal electrowinning method applying various chloride baths including that of nickel metal and cobalt metal.

Solution to the Problems

The first means to solve the problems to achieve the above-mentioned aims by the present invention is, in the metal electrowinning method using an anode for electrolysis and applying a chloride bath, to prepare said anode comprising a substrate comprising titanium or titanium alloy, and a coating layer comprising a plurality of a unit layer, provided on the surface of the substrate by the thermal decomposition baking method, wherein the unit layer comprises the first coating layer comprising a mixture of iridium oxide, ruthenium oxide and titanium oxide and the second coating layer comprising a mixture of platinum and iridium oxide, and the first coating layer of the unit layer formed on the surface of said substrate is contact with the surface of said substrate, and an outer coating layer of the unit layer formed on the outermost layer of said coating layer is the second coating layer, characterized in that said coating layer is provided on the surface of the substrate by means of the thermal decomposition baking method, followed by post-baking at a baking temperature higher than that by the thermal decomposition baking method.

The second means to solve the problems by the present invention for the anode for the metal electrowinning method is a baking temperature applied in the range of 350 degrees Celsius-520 degrees Celsius.

The third means to solve the problems by the present invention for the anode for the metal electrowinning method is a post-baking temperature being higher than the formerly applied in the thermal decomposition baking method, to a temperature of 475 degrees Celsius-550 degrees Celsius.

The forth means to solve the problems by the present invention for the anode for the metal electrowinning method is the composition ratios of iridium, ruthenium and titanium of the first coating layer being in the range of 20-30 mol. %, 25-30 mol. %, and 40-55 mol. %, respectively.

The fifth means to solve the problems by the present invention for the anode for the metal electrowinning method is the composition ratios of platinum and iridium of the second coating layer being in the range of 60-80 mol. % and 20-40 mol. %, respectively.

The sixth means to solve the problems by the present invention is, in the metal electrowinning method using an anode for electrolysis provided with a coating layer comprising a plurality of a unit layer comprising the first coating layer comprising a mixture of iridium oxide, ruthenium oxide and titanium oxide and the second coating layer comprising a mixture of platinum and iridium oxide, laminated on the surface of the substrate comprising titanium or titanium alloy, wherein the anode is manufactured by the manufacturing method characterized in steps, comprising:

1) a step to prepare the first coating layer comprising a mixture of iridium oxide, ruthenium oxide and titanium oxide by coating a mixing solution of iridium compound, ruthenium compound and titanium compound on the surface of substrate comprising titanium or titanium alloy by means of the thermal decomposition baking method for heat-baking;

2) a step to prepare the second coating layer comprising a mixture of platinum and iridium oxide by coating a mixing solution of platinum compound and iridium compound on the surface of the first coating layer by means of the thermal decomposition baking method for heat-baking;

3) a step to prepare a single or a plurality of unit layer comprising the first coating layer and the second coating layer on the surface of the second coating layer by the thermal decomposition baking method, wherein the first coating layer of the unit layer formed on the surface of said substrate is contact with the surface of said substrate and a coating layer of the outermost layer of the unit layer is the second coating layer, and 4) a step to provide said coating layer with post-baking at a higher baking temperature than the temperature by the thermal decomposition baking method.

Advantageous Effect of the Invention

According to the present invention, a lower chlorine overvoltage is achieved compared with the former anodes, and thus, the electrowinning method of metals which can reduce power consumption substantially is realized.

BRIEF DESCRIPTION OF THE DRAWINGS

FIG. 1 A variation of overvoltage of the anode using in the present invention and comparative example.

DETAILED DESCRIPTION OF THE INVENTION AND PREFERRED EMBODIMENTS

The following explains, in detail, the present invention. The present invention relates to an electrowinning method of metals using an anode and through electrolysis of a metal chloride solution. Said anode is manufacture by the following method.

In the present invention, as the first step, the surface of a substrate comprising titanium or titanium alloy is degreased and roughened on its surface with etching by acid treatment, blast treatment, etc. Then, a mixture solution of iridium compound, ruthenium compound, and titanium compound is coated on the surface of the substrate comprising titanium or titanium alloy by using a brush, roller, or spray or by dipping, followed by heat-baking treatment by the thermal decomposition baking method, to prepare the first coating layer comprising a mixture of iridium oxide, ruthenium oxide, and titanium oxide. As an anode substrate, applicable shapes include plate, rod, expanded metal, and porous metal.

In this way, to prepare the first coating layer as the first layer, the surface of a substrate comprising titanium or titanium alloy is degreased and roughened on its surface with etching by acid treatment, blast treatment, etc. Then, a mixture solution of iridium compound, ruthenium compound, and titanium compound is coated on the surface of the substrate comprising titanium or titanium alloy by using a brush, roller, or spray or by dipping, followed by heat-baking treatment by the thermal decomposition baking method.

As the iridium compound, iridium trichloride, hexachloroiridate, ammonium hexachloroiridate, and sodium hexachloroiridate, etc. are used; as the ruthenium compound, ruthenium trichloride, hexachlororuthenate, etc. are used; and as titanium compound, titanium trichloride, titanium tetrachloride and butyl titanate are used. As catalyst for the mixture solution, water, hydrochloric acid, nitric acid, ethyl alcohol, methyl alcohol, isopropanol, butyl alcohol, lavender oil, aniseed oil, linaloe oil, turpentine oil, toluene, methyl ether, ethylene ether, etc. are applicable. After being coated, the substrate is dried for several tens of minutes at a temperature of 60-200 degrees Celsius to evaporate the solvent and subjected to the heat treatment at 350 degrees Celsius-520 degrees Celsius for 10-20 minutes in an electric oven with air or oxygen atmosphere.

The primary feature of the present invention lies in providing the first coating layer comprising a mixture layer of iridium oxide, ruthenium oxide, and titanium oxide as a coating contacting the surface of the substrate comprising titanium or titanium alloy, which improves adherence of the coating layer to the substrate because of the titanium in the substrate and the titanium in the first coating layer. In the cited Japanese Unexamined Patent Application Publications No. 58-136790, No. 62-240780 and No. 62-243790 (Patent Documents 1-3), platinum-iridium oxide layer is applied as the layer contacting the surface of the substrate, but since titanium which is the same component as the substrate is not contained in that coating layer, adherence of that coating layer to the substrate is insufficient.

The first coating layer by the present invention is provided by the thermal decomposition baking method, to which a temperature of 350 degrees Celsius-520 degrees Celsius is usually applied as the temperature of thermal decomposition baking. When the temperature of the thermal decomposition baking is below 350 degrees Celsius, thermal decomposition does not occur in full, and when it exceeds 520 degrees Celsius, the substrate is progressively oxidized and damaged. In addition, the composition ratio of iridium, ruthenium and titanium of the first coating layer is desirable in the range of 20-30 mol. %, 25-30 mol. %, and 40-55 mol. %, respectively.

Then, the second coating layer comprising a mixture of platinum and iridium oxide is provided on the surface of the first coating layer by coating a mixture of platinum compound and iridium compound. The temperature of the thermal decomposition baking is the same as applied to the first coating layer. The composition ratio of platinum and iridium of the second coating layer is desirable in the range of 60-80 mol. % and 20-40 mol. %, respectively.

The second coating layer is formed on the surface of the first coating layer in such a manner that a mixture solution of platinum compound including hexachloroplatinate, ammonium hexachloroplatinate, potassium hexachloroplatinate, diammine dimitro platinum and iridium compound including iridium trichloride and hexachloroiridate is coated on the surface of the first coating layer, followed by baking.

As the solvent, water, hydrochloric acid, nitric acid, ethyl alcohol, methyl alcohol, propyl alcohol, butyl alcohol, methyl ether, ethyl ether, etc. are applied.

After the coating, the substrate is dried for several tens of minutes at a temperature of 60-200 degrees Celsius to evaporate the solvent, and treated in an electric oven with air or oxygen atmosphere at a temperature of 350 degrees Celsius-520 degrees Celsius for 10-20 minutes for thermal decomposition of these compounds.

Then, a unit layer comprising the first coating layer and the second coating layer is provided on the surface of the second coating layer by three layers, by the thermal decomposition baking method, whereby four unit layers are totally formed. It is preferable for the unit layer comprising the first coating layer and the second coating layer to be piled by 3-4 layers. In each unit layer, the first coating layer is firstly formed, and then the second coating layer is formed on the surface of the first coating layer, and this order is identical in each unit layer.

The secondary feature of the present invention is providing the second coating layer comprising a mixture of platinum and iridium oxide as the outermost layer of the coating layers; thereby the amount of by-product oxygen can be further reduced with simultaneous effect of reduced overvoltage.

In cited Japanese Unexamined Patent Application Publications No. 62-240780 and No. 62-243790 (Patent Documents 2 and 3), a mixture layer of iridium oxide, ruthenium oxide, and titanium oxide is prepared as the outermost layer, but in these cases, the chlorine overvoltage is high and the amount of by-product oxygen is proven to be large.

Successively, a plurality of coating layer is subject to the post-baking at a higher temperature than the baking temperature by the thermal decomposition baking method. It is desirable that the post-baking temperature is higher than the baking temperature, preferably, at a temperature of 475 degrees Celsius-550 degrees Celsius. When the post-baking temperature exceeds 550 degrees Celsius, it is feared that overvoltage rises.

The tertiary feature of the present invention is post-baking which is added after the formation of a plurality of coating layer by the thermal decomposition baking method, at a temperature higher than the baking temperature by the thermal decomposition baking method; thereby the amount of by-product oxygen is further reduced.

In cited Japanese Unexamined Patent Application Publications No. 62-240780 and No. 62-243790 (Patent Documents 2 and 3), post-baking is not performed and neither the amount of by-product oxygen nor the overvoltage decreased.

EXAMPLES

The following explains examples of the present invention; however the present invention shall not be limited to these examples.

Example 1

The substrate is a titanium mesh (6.0 mm long×3.5 mm wide×1 mm thick). As the pretreatment, the substrate is conditioned by annealing for 60 minutes at 590 degrees Celsius, followed by sufficient surface-roughening with alumina particles, and etching treatment in a boiling 20 mass % hydrochloric acid.

The coating solution 1 was prepared, using hydrochloric acid and isopropanol as the solvent, and ruthenium trichloride, iridium trichloride, titanium trichloride and titanium tetrachloride as the metal material in each metal compound at a composition ratio of 25 mol. % of ruthenium, 25 mol. % of iridium, and 50 mol. % of titanium.

Then, the coating solution 2 was prepared, using nitric acid as the solvent, and diammine dinitro platinum and iridium trichloride as the metal material in each metal compound at a composition ratio of 70 mol. % of platinum and 30 mol. % of iridium.

The coating solution 1 was applied on the surface of the titanium substrate, followed by drying at 60 degrees Celsius and baked for 15 minutes in an electric oven at 475 degrees Celsius to form the first coating layer of $IrO_2$—$RuO_2$—$TiO_2$.

On the surface of the first coating layer, the coating solution 2 was applied, followed by drying at 60 degrees Celsius and baked for 15 minutes in an electric oven at 475 degrees Celsius to form the second coating layer of Pt—$IrO_2$.

The unit layer of comprising the first coating layer and the second coating layer were provided on said second coating, wherein four unit layers are totally formed, followed by the post baking treatment for 60 minutes at 520 degrees Celsius to manufacture an anode. The outermost layer was the Pt—$IrO_2$ layer, and the total coating amount, as metal, of the first coating layer was 2.06 g/m$^2$ and that of the second coating layer was 1.06 g/m$^2$.

The chlorine evolution voltage of the obtained electrode sample 1 was evaluated in the one-compartment type beaker cell ($NiCl_2$ aqueous solution 125 g/L-Cl, 90 degrees Celsius). As a result, the overvoltage at 1 A/dm$^2$ was 10.072V vs. SCE and an extremely low chlorine overvoltage was shown.

According to Example 1, the chlorine overvoltage was reduced as showed above. The result of example 1 was shown in Table 1 and FIG. 1.

TABLE 1

| | Current Density/A/dm$^2$ | Chlorine Evolution Voltage/ V vs. SCE |
|---|---|---|
| Example 1 | 1 | 1.072 |
| Example 2 | 2 | 1.082 |
| Example 3 | 3 | 1.084 |
| Example 4 | 4 | 1.090 |
| Example 5 | 5 | 1.091 |
| Example 6 | 6 | 1.094 |

Example 2-6

As Examples 2-6, the chlorine evolution voltage of the electrode sample 1 was measured at 2 A/dm$^2$, 3 A/dm$^2$, 4 A/dm$^2$, 5 A/dm$^2$, 6 A/dm$^2$, in the same manner with Example 1, except for alternation of the current density from 1 A/dm$^2$.

The results of Examples 2-6 were also shown in Table 1 and FIG. 1 and the chlorine overvoltage was extremely reduced in the same way as Example 1.

Comparative Example 1

As Comparative Example 1, electrode sample 2 was prepared using only the coating solution 1, being different from Example 1 and the coating layer of $IrO_2$—$RuO_2$—$TiO_2$ was formed.

The chlorine evolution voltage of the electrode sample 2 was measured at 1 A/dm$^2$, in the same cell as with Example 1. As a result, the overvoltage was 1.104 V vs. SCE. The result of Comparative Example 1 was shown in Table 2 and FIG. 1.

TABLE 2

| | Current Density/A/dm$^2$ | Chlorine Evolution Voltage/ V vs. SCE |
|---|---|---|
| Comparative Example 1 | 1 | 1.104 |
| Comparative Example 2 | 2 | 1.118 |
| Comparative Example 3 | 3 | 1.124 |
| Comparative Example 4 | 4 | 1.129 |
| Comparative Example 5 | 5 | 1.133 |
| Comparative Example 6 | 6 | 1.138 |

Comparative Example 2-6

As Comparative Examples 2-6, the chlorine evolution voltage of the electrode sample 2 was measured at 2 A/dm$^2$, 3 A/dm$^2$, 4 A/dm$^2$, 5 A/dm$^2$, 6 A/dm$^2$, in the same manner with Example 1, except for alternation of the current density from 1 A/dm$^2$.

The results of Comparative Examples 2-6 were also shown in Table 2 and FIG. 1 and the chlorine overvoltage was high in the same way as Comparative Example 1.

From comparisons between Examples 1 and Comparative Example 1, the reduction of chlorine overvoltage by 32 mV was achieved. From calculating a reduction effect of annual electric power amount of consumption as a sum of an electrode area of 1000000 dm$^2$, the effect is as follows.

a reduction effect of annual electric power amount of consumption=an overvoltage reduction amount×a current density×a sum of an electrode area×an electrolysis hour=0.032 V×1 A/dm$^2$×1000000 dm$^2$×8000 h=256000 kWh As above mentioned, according to Example 1 compared with Comparative Example 1, a reduction effect of annual electric power amount of consumption of about 260 thousand kWh was achieved.

INDUSTRIAL APPLICABILITY

The present invention can be utilized in the metal electrowinning method for various chloride baths including that of nickel metal and cobalt metal, in which metal chloride solution is electrolyzed to precipitate metal on the cathode.

The invention claimed is:

1. A method for a metal electrowinning comprising:

precipitating a metal from a metal chloride solution in a bath provided with an anode for electrolysis, wherein said anode comprises a substrate comprising titanium or titanium alloy, and a coating comprising a plurality of unit layers, provided on a surface of the substrate, each of the unit layers comprises a first coating layer comprising a mixture of iridium oxide, ruthenium oxide and titanium oxide, and a second coating layer comprising a mixture of platinum and iridium oxide, the first coating layer of one of the unit layers formed on the surface of said substrate is in contact with the surface of said substrate, in each unit layer, the second coating layer is formed on the first coating layer and one of the second coating layers is formed as an outmost layer of the coating, and said coating is provided on the surface of the substrate by a thermal decomposition baking method, followed by post-baking at a baking temperature higher than that of the thermal decomposition baking method.

2. A method for a metal electrowinning according to claim 1, wherein the baking temperature of the thermal decomposition baking method is 350 degrees Celsius-520 degrees Celsius.

3. A method for a metal electrowinning according to claim 1, wherein the post-baking temperature is higher than the temperature of the thermal decomposition baking method, and is in a temperature range of 475 degrees Celsius-550 degrees Celsius.

4. A method for a metal electrowinning according to claim 1, wherein the composition ratios of iridium, ruthenium and titanium of the first coating layer in said anode are in the range of 20-30 mol. %, 25-30 mol. %, and 40-55 mol. %, respectively.

5. A method for a metal electrowinning according to claim 1, wherein the composition ratios of platinum and iridium of the second coating layer in said anode are in the range of 60-80 mol. % and 20-40 mol. %, respectively.

6. A method for a metal electrowinning according to claim 1, wherein said anode is manufactured by the manufacturing method comprising:

1) providing the first coating layer comprising a mixture of iridium oxide, ruthenium oxide and titanium oxide by coating a mixing solution of iridium compound, ruthenium compound and titanium compound on the surface of the substrate comprising titanium or titanium alloy and then carrying out the thermal decomposition baking method;

2) providing the second coating layer comprising a mixture of platinum and iridium oxide by coating a mixing solution of platinum compound and iridium compound on the surface of the first coating layer and then carrying out the thermal decomposition baking method;

3) providing at least one additional unit layer comprising the first coating layer and the second coating layer on the surface of the second coating layer formed in step 2) by the thermal decomposition baking method, and 4) post-baking the product of step 3) at a higher baking temperature than the temperature of the thermal decomposition baking method.

* * * * *